US006003909A

United States Patent [19]

Daoud

[11] Patent Number: 6,003,909

[45] Date of Patent: Dec. 21, 1999

[54] HIDDEN LATCH SECURITY OVERRIDE SYSTEM

[75] Inventor: Bassel Hage Daoud, Parsippany, N.J.

[73] Assignee: Lucent Technologies Inc., Murray Hill, N.J.

[21] Appl. No.: 09/106,928

[22] Filed: Jun. 29, 1998

[51] Int. Cl.[6] ..... E05C 1/02

[52] U.S. Cl. ..... 292/180; 70/465; 70/DIG. 63; 70/2; 292/281; 292/253

[58] Field of Search ..... 292/177, 178, 292/179, 180 R, 181, 182, 152, 205, DIG. 65, 253, 281; 70/465, DIG. 63, 160, 161, 162, 180, 2; 379/399, 445

[56] References Cited

U.S. PATENT DOCUMENTS

| | | | |
|---|---|---|---|
| 1,961,041 | 5/1934 | Gilbert, Jr. | 292/148 |
| 2,825,218 | 3/1958 | O'Brien | 70/7 |
| 3,572,062 | 3/1971 | Beebe | 70/1.5 |
| 3,889,498 | 6/1975 | Harrell | 70/78 |
| 3,926,018 | 12/1975 | Joersz | 70/19 |
| 3,938,837 | 2/1976 | Bright | 292/148 |
| 4,229,956 | 10/1980 | Thorburn | 70/129 |
| 4,290,281 | 9/1981 | Knaack et al. | 70/54 |
| 4,782,675 | 11/1988 | Thorburn | 70/129 |
| 5,076,078 | 12/1991 | Weger, Jr. | 70/54 |
| 5,092,143 | 3/1992 | Rumbles | 70/56 |
| 5,312,266 | 5/1994 | Daoud | 439/304 |
| 5,315,849 | 5/1994 | Georgopoulos | 70/34 |
| 5,497,416 | 3/1996 | Butler, III et al. | 379/399 |
| 5,740,685 | 4/1998 | Daoud | 70/164 |
| 5,743,116 | 4/1998 | Suster | 70/14 |

*Primary Examiner*—Darnell M. Boucher
*Assistant Examiner*—John B. Walsh

[57] ABSTRACT

A security override system for a locked box comprising a first hasp portion mounted within a box and extending through a first opening in an outer door of the box; a second hasp portion connected to a bracket; the bracket slideably mounted within the box such that the second hasp portion extends through a second opening in the outer door, said sliding of the bracket being governed by a disguised false hinge latch which is connected to the outer door and extends through the bracket and a third opening in the outer door and is movable between a holding position and a released position; the bracket being movable between a closed position wherein the second hasp portion mates with the first hasp portion to form a padlock receiving portion for locking the outer door with a padlock and an open position wherein the second hasp portion does not mate with the first hasp portion; and wherein the outer door can be unlocked by moving the disguised latch to the released position so as to permit movement of the bracket into the open position for removing a locked padlock inserted in the padlock receiving section without first unlocking the padlock.

28 Claims, 4 Drawing Sheets

HIDDEN LATCH SECURITY OVERRIDE SYSTEM

FIELD OF THE INVENTION

This invention relates to a security system for use with a junction box, a Building Entrance Protector, or other enclosure, and in particular, to a hidden latch security override system for permitting access to the enclosure when padlocked, without the need to unlock the padlock.

BACKGROUND OF THE INVENTION

Junction boxes have long been used to collect and protect telephone and electrical wires for distribution, splicing, cross connection and other uses. In the telephony arts, such junction boxes are more commonly known as network interface units (NIUs) and/or building entrance protectors (BEPs).

In a telephone network, a network cable from the central office is connected to a BEP located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99 type connector block, such as are available from Lucent Technologies Inc. The customer telephone equipment is coupled through the connector block to a central office (CO) telephone line. The CO line side of the connector is generally the bottom side of the connector block, where the CO line tip-ring wire pairs are connected using a wire-wrapping tool.

The BEP generally has a lockable outer door to prevent unauthorized access to the components inside. The outer door is generally secured by a keyed or combination type padlock, and the building owner retains possession of the only key (or combination). Frequently, it is necessary for others in addition to the building owner to open the BEP for servicing or maintenance, for example, telephone company technicians or contractors acting in their capacity. Such servicing will at times occur during non-business hours or at other times when the building owner cannot be located or is not available. If the building owner is not available the technician wishing to service the BEP would not be able to do so because the building owner has the only key to the padlock. The technician would then have to come back at a later date when the building owner was available, which is both inconvenient to the technician, and costly to the building owner and their customers. Also, if the key or combination to the padlock was lost, it would be necessary to saw off the padlock in order to access the components within the BEP. Accordingly, a mechanism for overriding the padlock is desired, while at the same time maintaining the appearance of a secure, locked utility box.

SUMMARY OF THE INVENTION

The present invention provides a security override mechanism for accessing the components within a padlocked utility box without having to first unlock the padlock, while at the same time maintaining the appearance of a secure, locked utility box.

The mechanism consists of a one-sided hasp portion connected to a U-shaped bracket. The hasp portion is at the approximate center of the longitudinal length of the bracket and extends substantially perpendicular to the longitudinal length of the bracket. The bracket, and hasp portion connected thereto, is slideably mounted to the inside of the outer door of tile utility box, and the hasp portion of the bracket extends through the outer door of the utility box. The hasp/bracket is slideable between a closed position and an open position. The bracket has two oval cutouts to accept two corresponding guide bolts which are attached to the inside surface of the outer door. The bracket also has a cutout to accept a false hinge latch which is attached to the one of the guide bolts. The false hinge latch is movable between a closed position and an open position. When the false hinge latch is in its open position the latch is within the utility box and the hasp/bracket is slideably movable; when the false hinge latch is in its closed position, a portion of the latch extends through both the bracket and outer door and the hasp/bracket is immovable. The bracket, and corresponding hasp portion, is guided between its open and closed positions by the interaction of the guide bolts and the corresponding oval cutouts. A spring is attached to the inside of the outer door at one end of the bracket. The spring biases the hasp/bracket towards its closed position.

An oppositely facing one-sided fixed hasp portion is fixedly mounted to a wall within the utility box and extends through an opening in the outer door of the utility box to mate with the one-sided sliding hasp portion connected to the bracket. When the sliding hasp portion is in its open position, there is a gap between the sliding hasp portion and the fixed hasp portion such that a locked padlock can pass between them for removal. When the sliding hasp portion is in its closed position, it mates with the fixed hasp portion to form a fully closed hasp with an opening to receive a padlock, just as in a conventional padlock hasp. Thus, when the outer door is closed and the sliding hasp portion is in its closed position mating with the fixed hasp portion, an unlocked padlock may be inserted through the opening and locked, preventing the door from opening.

Two false hinge pin connectors are mounted on the outside surface of the outer door of the utility box at a point above the slideable hasp portion when it is in its closed position. The false hinge pin connectors are constructed to align with the false hinge latch on each side thereof when the false hinge latch is in its closed position, giving the appearance to passersby that the slideable hasp portion is actually hingeably mounted to the outer door. As more fully described below, when the slideable hasp portion and false hinge latch are in their respective closed positions, the slideable hasp portion cannot be moved. Therefore, it would appear to passersby as though in order to open the outer door of the BEP, the padlock would need to be unlocked first, and that the slideable hasp portion would then hingeably swing upwards to open the outer door. However, by moving the false hinge latch to its open position, the bracket and corresponding hasp portion are rendered movable, allowing for the slideable hasp portion to be separated from the fixed hasp portion, whereupon a locked padlock can be removed and the outer door can be opened without first unlocking the padlock.

Thus, while the utility box looks as though it cannot be opened without first unlocking the padlock, the technician or other authorized user knowledgeable in its construction can open the outer door of the utility box without unlocking the padlock. Also, should the key to the padlock become lost, the building owner can open the utility box without having to cut off the padlock.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

DESCRIPTION OF THE DRAWING FIGURES

In the drawing figures, which are not to scale, and which are merely illustrative, and wherein like reference numerals depict like elements throughout the several views.

Figure 1B:
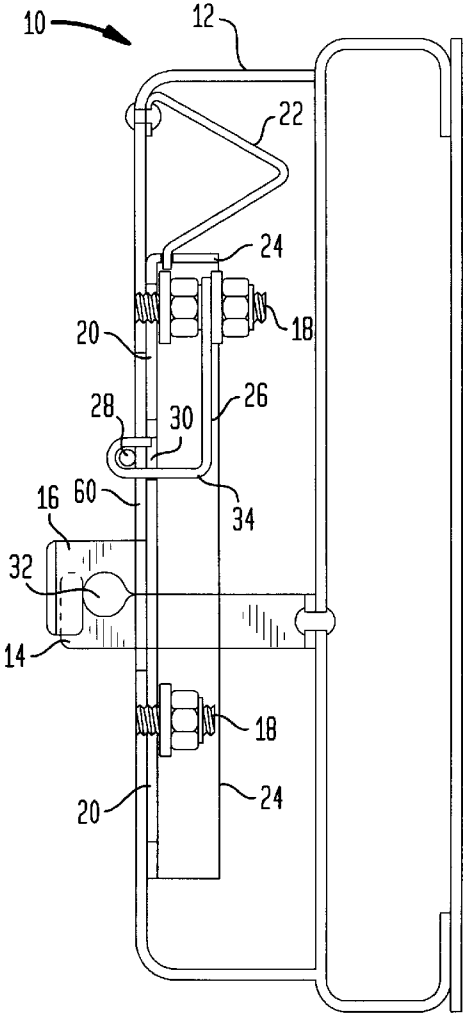
FIG. 1B is a side elevational cutaway view of the hidden latch security override system depicted in FIG. 1A.
Figure 1A:
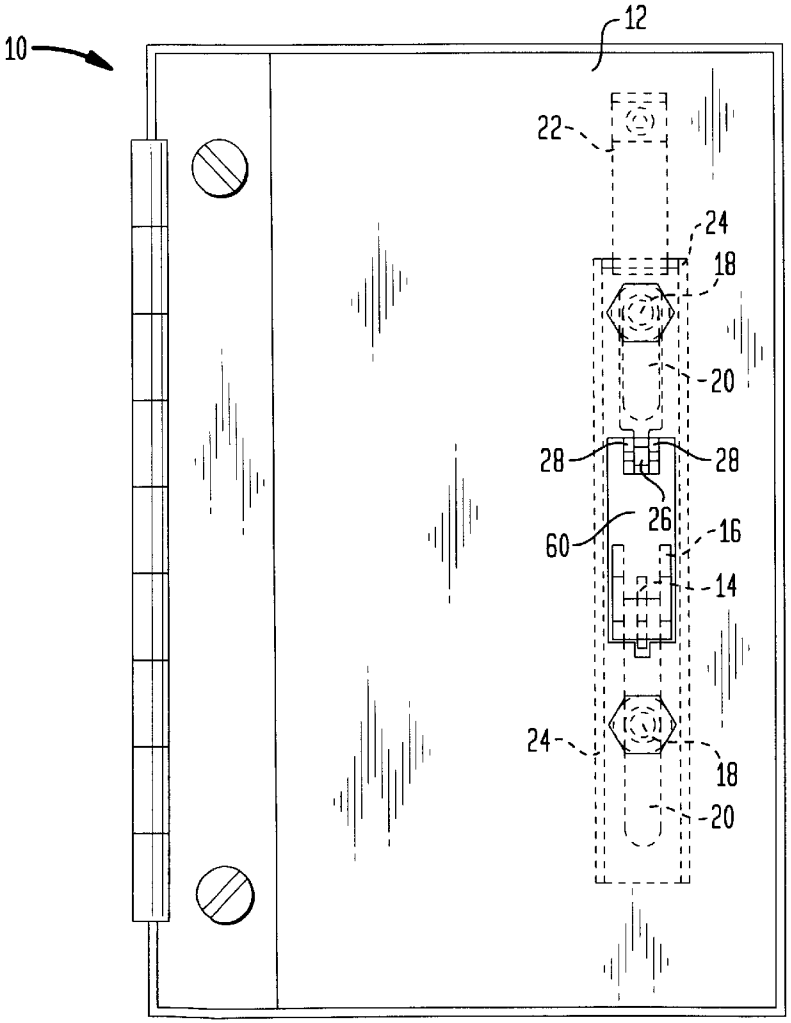
FIG. 1A is a front elevational view of hidden latch security override system constructed in accordance with a preferred embodiment of the present invention mounted to a utility box and with the system in its closed and locked position.
Figure 2B:
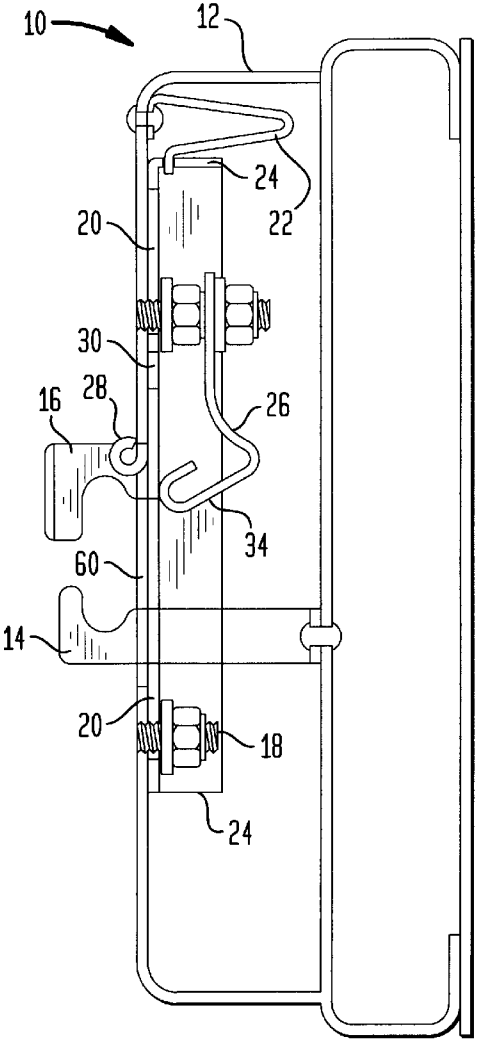
FIG. 2A is a front elevational view of hidden latch security override system constructed in accordance with a preferred embodiment of the present invention mounted to a utility box and with the system in its open and unlocked position.
Figure 2A:
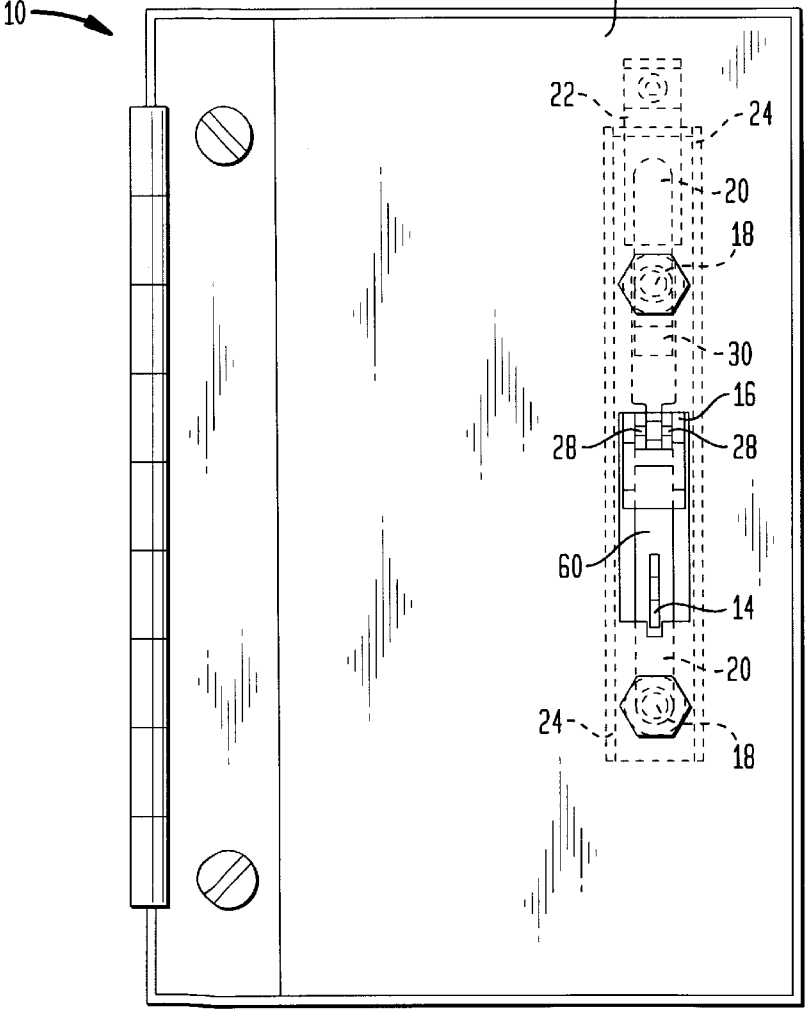
Figure 3:
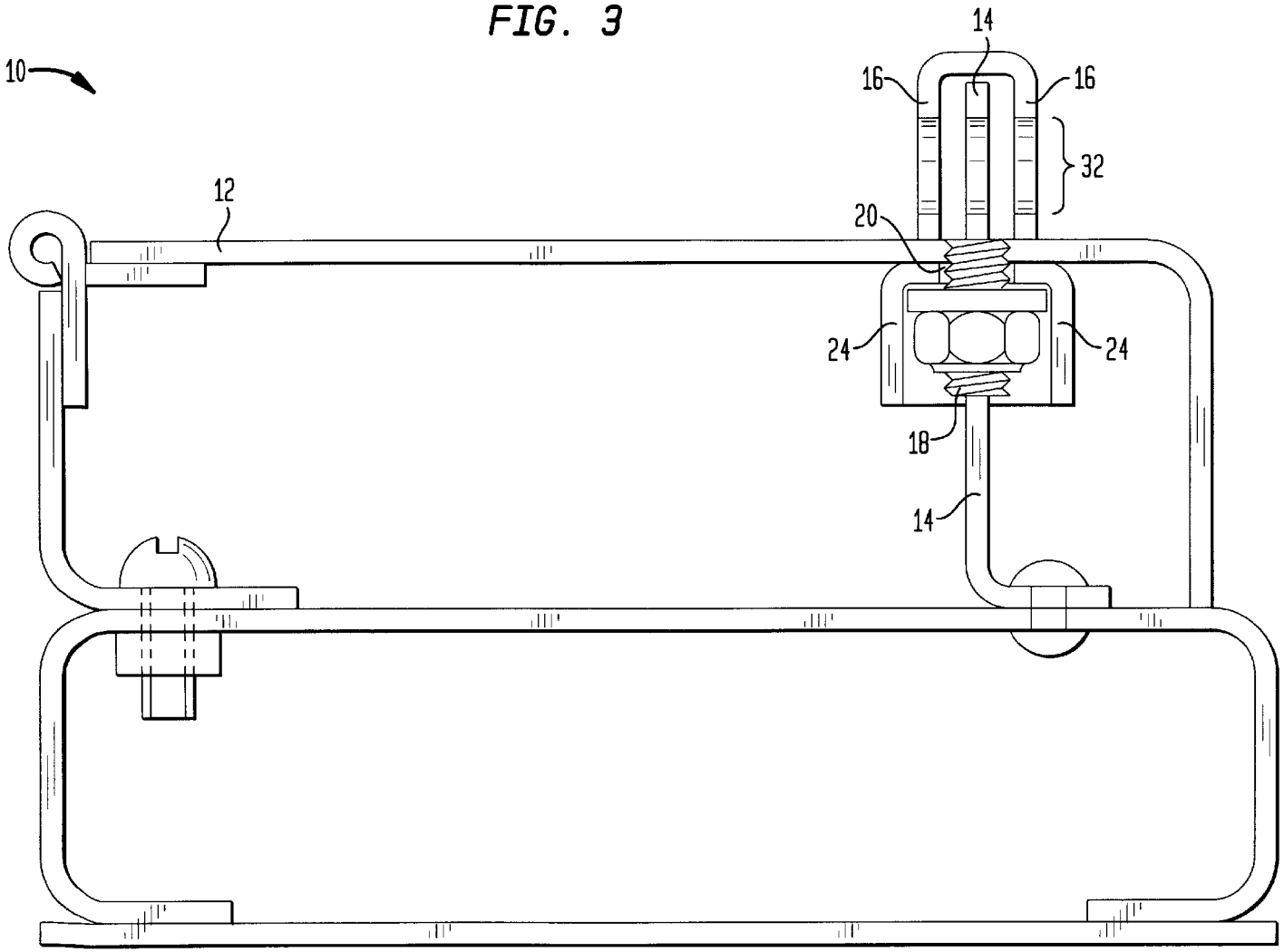
Figure 6:
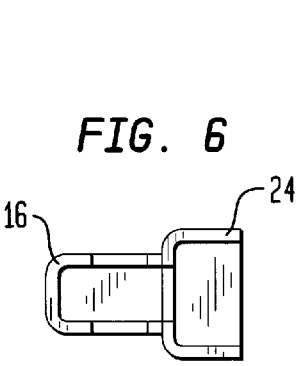
Figure 8:
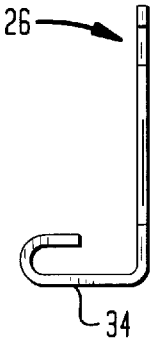
Figure 7:
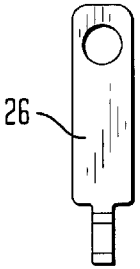
Figure 5:
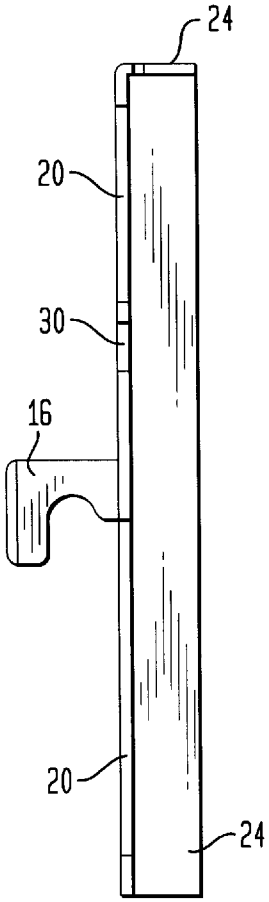
Figure 4:
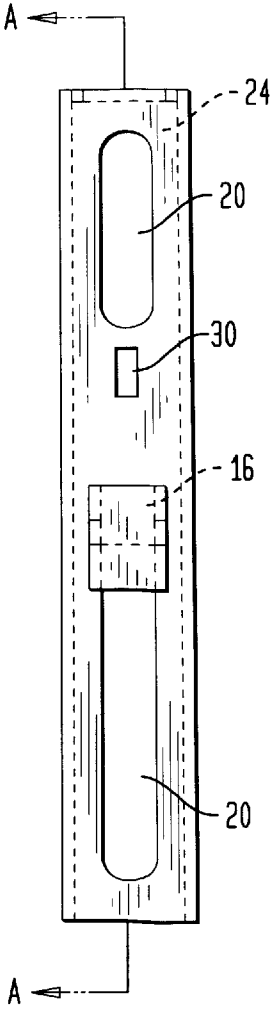

FIG. 2B a side elevational cutaway view of the hidden latch security override system depicted in FIG. 2A;

FIG. 3 is a bottom cutaway view of the hidden latch security override system depicted in FIG. 1A;

FIG. 4 is a front view of the slideable hasp/bracket portion of the hidden latch security override system;

FIG. 5 is a side sectional view taken along line A—A of FIG. 4;

FIG. 6 is a bottom view of the slideable hasp/bracket portion depicted in FIG. 4;

FIG. 7 is a plan view of the false hinge latch of the hidden latch security override system depicted in FIG. 1A, and FIG. 8 is a side view of the false hinge latch of FIG. 7.

DETAILED DESCRIPTION OF THE PREFERRED EMBODIMENTS

FIGS. 1A through 2B depict a hidden latch security override system constructed according to a preferred embodiment of the present invention. The security override system generally includes a fixed one sided hasp portion 14 mounted within a utility box 10 and extending through an opening 60 in outer door 12 of utility box 10. Fixed hasp portion 14 is constructed to mate with a slideable one-sided hasp portion 16, preferably generally L-shaped when viewed from the side (FIGS. 2B, 5), and generally shaped as an inverted U when viewed from it front (FIGS. 3, 6), which is connected to a bracket 24 which is in turn mounted to the inside surface of outer door 12 of utility box 10. The slideable hasp/bracket is movable between an open and a closed position with respect to the fixed hasp portion 14. When slideable hasp portion 16 is in its closed position it mates with, and partially covers (FIGS. 1B, 3) fixed hasp portion 14 and forms a padlock receiving section 32 therebetween (FIG. 1B), giving the impression of a conventional padlock hasp. When slideable hasp portion 16 is in its open position there is a space between slideable hasp portion 16 and fixed hasp portion 14 such that a locked padlock can be passed therebetween (FIG. 2B). The hasp portions, and utility box, can be constructed of any number of materials, such as, by way of a non-limiting example, metal or plastic, or any other material having the necessary rigidity and strength characteristics to fulfill the functions described herein.

As seen in FIGS. 4, 5 and 6, slideable hasp portion 16 is connected to a generally U-shaped bracket 24 at the approximate center of the longitudinal length of bracket 24, and extends substantially perpendicular to the longitudinal length of bracket 24. As seen in FIG. 3, bracket 24, and hasp portion 16 connected thereto, is slideably mounted to the inside of the outer door 12 of utility box 10, and hasp portion 16 extends through a portion of opening 60 of outer door 12 of utility box 10. As seen in FIG. 4, bracket 24 has two oval cutouts 20 to accept two corresponding guide bolts 18 which are attached to the inside surface of outer door 12 (FIG. 2B). Bracket 24 also has a false hinge latch cutout 30 to accept a false hinge latch 26 which is attached to upper guide bolt 18. In a preferred embodiment, as shown in FIG. 2B, by way of a non-limiting example, the hasp portions are L-shaped. However, the hasp portions can be any number of shapes such that a padlock receiving section is formed upon their mating without departing from the spirit of the invention.

As best seen in FIGS. 1B and 2B, false hinge latch 26 (FIGS. 7 and 8) is connected to upper guide bolt 18 and is movable between a holding position and a released position. Latch 26 is preferably made of an elastically deformable, resilient material that may be, for example, spring steel, plastic, or the like, or it may be a substantially rigid member with spring hinge (not shown). As seen in FIG. 1B and 2B, false hinge latch 26 is biased towards its holding position. When false hinge latch 26 is in its released position, the latch is behind outer door 12 of utility box 10 and the hasp/bracket is movable to its open position. As seen in FIG. 1B, when false hinge latch 26 is in its holding position, a portion of latch 26 extends through bracket 24 through cutout 30, and through a portion of opening 60 in outer door 12, and the hasp/bracket is immovable. As best seen in FIG. 3, bracket 24, and corresponding hasp portion 16, is guided between its open and closed positions by the interaction of the guide bolts 18 and corresponding oval cutouts 20. A spring 22 is attached to the inside of outer door 12 at one end of the bracket 24. Spring 22 biases the bracket 24 towards its closed position. The guided movement of bracket 24 may be achieved in other art-recognize manners, such as via guide channels or rails. Spring 22 may be any type of biasing member, such as the elastic tab shown or it may be a coil spring, or elastic rod, rubber band or the like, provided it biases bracket 24 towards its closed position.

As seen in FIGS. 1A and 2B, two false hinge pin connectors 28 are mounted on the outside surface of outer door 12 of utility box 10 at a point above the slideable hasp portion 16 when slideable hasp portion 16 is in its closed position. The false hinge pin connectors 28 are constructed to align with false hinge latch 26 on each side thereof when false hinge latch 26 is in its holding position. Therefore, when false hinge latch 26 is in its holding position, the two false hinge pin connectors 28 are aligned with false hinge latch 26 (FIGS. 7 and 8) and it appears to passersby as though slideable hasp portion 16 is actually hingeably mounted to outer door 12. As more fully described below, when slideable hasp portion 16 is in its closed position and false hinge latch 26 is in its holding position, slideable hasp portion 16 cannot be moved. That is, as seen in FIG. 4, because false hinge latch 26 extends through false hinge latch cutout 30 and outer door 12, bracket 24 cannot slide towards its open position. Therefore, it appears to the uninitiated as though in order to open outer door 12 of the utility box 10, the padlock (not shown) would need to be unlocked first, and that then slideable hasp portion 16 would be hingeably swung upwards to open outer door 12 via the false "hinge" created by connectors 28 and latch 26.

However, by pushing false hinge latch 26 down and away from pin connectors 28, bracket 24 and corresponding hasp portion 16 are movable to their open position, whereupon a locked padlock (not shown) can be removed from padlock receiving section 32 and outer door 12 can be opened without first unlocking the padlock. For added security, an actual hinge pin (not shown) could be inserted through connectors 28 and latch 26, to further maintain the appearance of the "hinge", and to prevent inadvertent movement of latch 26.

Oppositely facing one-sided fixed hasp portion 14 is fixedly mounted to a rear wall or other suitable surface within the utility box 10 and extends through opening 60 in outer door 12 of utility box 10 to mate with the sliding hasp portion 16 connected to bracket 24. As seen in FIG. 2B, when sliding hasp portion 16 is in its open position, there is a gap between sliding hasp portion 16 and fixed hasp portion 14 such that a locked padlock (not shown) can pass between them. When sliding hasp portion 16 is in its closed position (FIG. 1B), it mates with fixed hasp portion 14 to form a padlock receiving section 32 to receive padlock therethrough.

As seen in FIG. 3, when outer door 12 is closed and sliding hasp portion 16 is in its closed position mating with the fixed hasp portion 14, an unlocked padlock (not shown) can be inserted through padlock receiving section 32 formed thereby and thereafter locked. The locked padlock (not shown) is therefore between outer door 12 and the two hasp portions 16 and 14, thus preventing outer door 12 from opening.

As seen in FIG. 1A, when sliding hasp portion 16 is in its closed position and the locked padlock (not shown) is installed in padlock receiving section 32, it would appear as though outer door 12 cannot be opened without first unlocking and removing the padlock. Furthermore, because false hinge latch 26 is aligned with false hinge pin connectors 28, it would appear as though slideable hasp portion 16 is actually hingeably mounted to outer door 12. Of course, outer door 12 could be opened by unlocking and removing the padlock without having to release false hinge latch 26 or moving sliding hasp portion 16 to its open position. However, as shown in FIG. 2B, the security mechanism can be overridden by the technician or building owner by releasing false hinge latch 26 and then moving sliding hasp portion 16 to its open position and passing the locked padlock (not shown) through the opening between the fixed hasp portion 16 and the sliding hasp portion 14.

As seen in FIG. 2B, by releasing false hinge latch 26, bracket 24 and sliding hasp portion 16 connected thereto are movable between an open and closed position. That is, as seen in FIG. 4, when false hinge latch 26 is in its holding position, bracket 24 cannot be moved because false hinge latch 26 extends through false hinge latch cutout 30 and through an opening in outer door 12, whereby bracket stop surface 34 (FIG. 8) contacts the lower edge of false hinge latch cutout 30, thus preventing movement of bracket 24. When false hinge latch 26 is released, bracket stop surface 34 does not contact the lower edge of false hinge latch cutout 30 and therefore bracket 24 is not prevented from moving. Accordingly, the technician can slide the hasp portion 16 to its open position and remove the locked padlock (not shown) and open outer door 12. As seen in FIG. 4, when false hinge latch 26 is in its holding position, false hinge latch 26 maintains bracket 24 in its closed position such that the outer door 12 can only be opened by unlocking and removing the padlock (or cutting the padlock off). Thus, while the utility box 10 looks as though it cannot be opened without first unlocking the padlock, the technician knowledgeable in its construction can open the outer door 12 of utility box 10 without first unlocking the padlock. Also, when the technician is finished servicing the utility box 10, he can close outer door 12, pass the locked padlock (not shown) back through the gap between slideable hasp portion 16 and fixed hasp portion 14 and slide slideable hasp 16 into its closed position, whereupon the bias of false hinge latch 26 will cause false hinge latch 26 to return to its holding position. Accordingly, the technician can both open and close the utility box without having to first unlock the padlock. Also, should the key to the padlock become lost, the building owner can open the utility box without having to cut off the padlock.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A security override system for a lockable box comprising:

a first hasp portion adapted to be mounted within a box and adapted to extend through a first opening in an outer door of said box;

a second hasp portion connected to a bracket adapted to be slideably mounted within said box such that said second hasp portion extends through said first opening, said sliding of said bracket being governed by a disguised latch which is adapted to be connected to said outer door and adapted to extend through said bracket and said first opening, said disguised latch being moveable between a holding position and a released position;

said bracket being movable between a closed position wherein said second hasp portion mates with said first hasp portion to form a padlock receiving portion, and an open position wherein said second hasp portion does not mate with said first hasp portion; and wherein securement of said outer door is controlled by moving said disguised latch to said released position so as to permit movement of said bracket into said open position for opening said padlock receiving portion to enable the selective insertion and removal of a locked padlock in said padlock receiving portion without first unlocking said padlock.

2. The security override system according to claim 1, wherein first opening comprises a first opening portion, a second opening portion and a third opening portion, said first hasp portion adapted to extend through said first opening portion, said second hasp portion adapted to extend through said second opening portion and said disguised latch adapted to extend through said third opening portion.

3. The security override system according to claim 1, wherein said bracket comprises a cutout to accept a corresponding guide bolt adapted to be mounted to said outer door for supportedly guiding the movement of said bracket.

4. The security override system according to claim 3, further comprising a biasing member to bias said bracket toward said closed position.

5. The security override system according to claim 1, further comprising a set of false hinge pin connectors adapted to be mounted on said outer door to align with said disguised latch when said disguised latch is in said holding position for disguising said disguised latch to appear as part of a hinge.

6. The security override system according to claim 3, wherein said disguised latch is connected to said guide bolt.

7. The security override system according to claim 2, wherein said first hasp portion is a fixed single blade L-shaped hasp portion.

8. The security override system according to claim 7, wherein said second hasp portion is a dual bladed L-shaped hasp portion.

9. The security override system according to claim 7, wherein said system is adapted to be mounted to a lockable box that is a Building Entrance Protector.

10. A utility box with a security override system comprising:

an outer door;

a first hasp portion mounted within said box and extending through a first opening in said outer door;

a second hasp portion connected to a bracket;

said bracket slideably mounted within said box such that said second hasp portion extends through a second opening in said outer door, said sliding of said bracket being governed by a disguised hinge latch which is connected to said outer door and extends through said bracket and a third opening in said outer door and is movable between a holding position and a released position;

said bracket being moveable between a closed position wherein said second hasp portion mates with said first hasp portion to form a padlock receiving portion for locking said outer door with a padlock and an open position wherein said second hasp portion does not mate with said first hasp portion; and wherein said outer door can be unlocked by moving said disguised latch to said released position so as to permit movement of said bracket into said open position for removing a locked padlock inserted in said padlock receiving section without first unlocking said padlock.

11. The utility box according to claim 10, wherein said disguised latch prevents movement of said bracket when said disguised latch is in said holding position.

12. The utility box according to claim 11, wherein said bracket comprises a cutout to accept a corresponding guide bolt mounted to said outer door.

13. The utility box according to claim 12, wherein said bracket is biased toward said closed position.

14. The utility box according to claim 11, further comprising a false hinge pin connector mounted on said outer door to mate with said disguised latch when said disguised latch is in said holding position.

15. The utility box according to claim 14, wherein said disguised latch is connected to said guide bolt.

16. The utility box according to claim 15, wherein said first hasp portion is a fixed single blade L-shaped hasp.

17. The utility box according to claim 16, wherein said second hasp portion is a dual blade L-shaped hasp.

18. The utility box according to claim 17, wherein said utility box is a Building Entrance Protector.

19. A method of overriding a security system for a locked box comprising the steps of:

(a) moving a disguised latch connected to an outer door of said box from a holding position wherein said disguised latch extends through a slideable bracket and an opening in said outer door to a released position wherein said disguised latch is behind said outer door;

(b) moving a second hasp portion connected to said bracket and extending through an opening in said outer door of said box from a closed position, wherein said second hasp portion mates with a first hasp portion fixedly connected to said box and extending through an opening in said outer door of said box to form a padlock receiving section, to an open position wherein said second hasp portion does not mate with said first hasp portion, said sliding of said bracket being governed by said disguised latch; and (c) removing a locked padlock inserted in said padlock receiving section without first unlocking said padlock and opening said outer door.

20. A security override system for a box with an outer door held shut by a locked padlock comprising:

a fixed hasp portion adapted to be fixedly attached within a box and adapted to extend outside said box through an opening in said outer door;

a slideable hasp portion adapted to be mounted to said outer door and movable between a closed position, wherein said slideable hasp portion mates with said fixed hasp portion to form an opening for an unlocked padlock to be passed therethrough, and an open position wherein there is a gap between said slideable hasp portion and said fixed hasp portion such that a locked padlock can pass therethrough;

a disguised latch adapted to be mounted to said outer door and movable between a holding position and a released position;

wherein said disguised latch prevents said slideable hasp portion from being moved from said closed position to said open position when said disguised latch is in said holding position; and wherein said slideable hasp portion is movable from said closed position to said open position when said disguised latch is in said released position such that said locked padlock can pass through said gap between said slideable hasp portion and said fixed hasp portion and said outer door can be opened without having to first unlock said locked padlock.

21. The security override system according to claim 20, wherein said slideable hasp portion is attached to a bracket, said bracket is adapted to be slideably mounted within said box such that said slideable hasp portion extends through an opening in said outer door.

22. The security override system according to claim 21, wherein said bracket comprises a cutout to accept a corresponding guide bolt adapted to be attached to said outer door.

23. The security override system according to claim 22, wherein said bracket is biased toward said closed position.

24. The security override system according to claim 23, further comprising a false hinge pin connector adapted to be mounted on said outer door to mate with said disguised latch when said disguised latch is in said holding position.

25. The security override system according to claim 24, wherein said disguised latch is connected to said guide bolt.

26. The security override system according to claim 24, wherein said fixed hasp portion is a single blade L-shaped hasp.

27. The security override system according to claim 26, wherein said slideable hasp portion is a dual blade L-shaped hasp.

28. The security override system according to claim 27, wherein said system is adapted to be mounted to a utility box that is a Building Entrance Protector.

* * * * *